US010889969B2

(12) United States Patent
Rowland et al.

(10) Patent No.: US 10,889,969 B2
(45) Date of Patent: Jan. 12, 2021

(54) SINK AND FAUCET ASSEMBLY

(71) Applicant: Component Hardware Group, Inc., Lakewod, NJ (US)

(72) Inventors: James Rowland, Bayville, NJ (US); Brion Gompper, Lakewood, NJ (US); Jon Dale Hoppe, Sussex, WI (US)

(73) Assignee: Components Hardware Group, Inc., Lakewook, NJ (US)

( * ) Notice: Subject to any disclaimer, the term of this patent is extended or adjusted under 35 U.S.C. 154(b) by 0 days.

(21) Appl. No.: 16/538,767

(22) Filed: Aug. 12, 2019

(65) Prior Publication Data

US 2019/0360182 A1 Nov. 28, 2019

Related U.S. Application Data

(62) Division of application No. 15/161,814, filed on May 23, 2016, now Pat. No. 10,378,189.

(51) Int. Cl.

| | |
|---|---|
| ***E03C 1/04*** | (2006.01) |
| ***E03C 1/02*** | (2006.01) |
| ***E03C 1/18*** | (2006.01) |

(52) U.S. Cl.

CPC ..... *E03C 1/0402* (2013.01); *E03C 1/021* (2013.01); *E03C 1/0403* (2013.01); *E03C 1/18* (2013.01); *E03C 2001/026* (2013.01)

(58) Field of Classification Search

CPC ..... E03C 1/0402
USPC ..... 4/675–677
See application file for complete search history.

(56) References Cited

U.S. PATENT DOCUMENTS

| | | | | |
|---|---|---|---|---|
| 10,378,189 | B2 * | 8/2019 | Rowland | E03C 1/021 |
| 2009/0250120 | A1 * | 10/2009 | Robbins | E03O 1/021 137/360 |

* cited by examiner

*Primary Examiner* — Lori L Baker
(74) *Attorney, Agent, or Firm* — Francis C. Hand; Corella Byrne, Esq.

(57) ABSTRACT

In order to front mount the faucet assembly on the sink, the connectors that are secured to the inlet ports are passed through enlarged openings in the splash board and the body of the faucet assembly is secured to the splash board via brackets. After positioning gaskets in place, the housing is moved over the body and dropped into place with the externally threaded ends of the cylindrical chambers and outlet port protruding through three circular openings in the housing.

6 Claims, 3 Drawing Sheets

SINK AND FAUCET ASSEMBLY

This application claims the benefit of Provisional Patent Application 62/167,956 filed May 29, 2015.

This application is a Division of U.S. Ser. No. 15/161,814, filed May 23, 2016, now U.S. Pat. No. 10,378,189.

The invention relates to a sink as well as to a faucet assembly for a sink.

As is known, many sinks have been fabricated for use in commercial establishments, such as restaurants, as well as for use in a residence. Generally, these sinks employ faucets that are mounted from behind the sink and prove cumbersome when repairs are required. For example, a Model KL45-4000 wall mounted faucet is available from Component Hardware Group, Inc. of Lakewood, N.J. that is mounted to a sink from behind.

It is an object of the invention to be able to mount a faucet assembly from the front of a sink.

It is another object of the invention to provide a faucet assembly that can be easily removed from a sink for repairs.

Briefly, the faucet assembly comprises a faucet assembly that is to be mounted on a splash board of a sink for delivering water into a tub of the sink.

The faucet assembly includes a body having at least one inlet port for connection to a source water and an outlet port for an outflow of water from the inlet port, a spigot in communication with the outlet port for delivering water therefrom, and a valve assembly mounted on the body in communication with the inlet port for selectively controlling a supply of water from the inlet port to the spigot. In addition, the faucet assembly includes a housing that is removably mounted over the body to enclose the body therein with the valve assembly projecting therethrough and the spigot projecting therethrough.

These and other objects and advantages of the invention will become more apparent from the following detailed description taken in conjunction with the drawings wherein.

Figure 2:
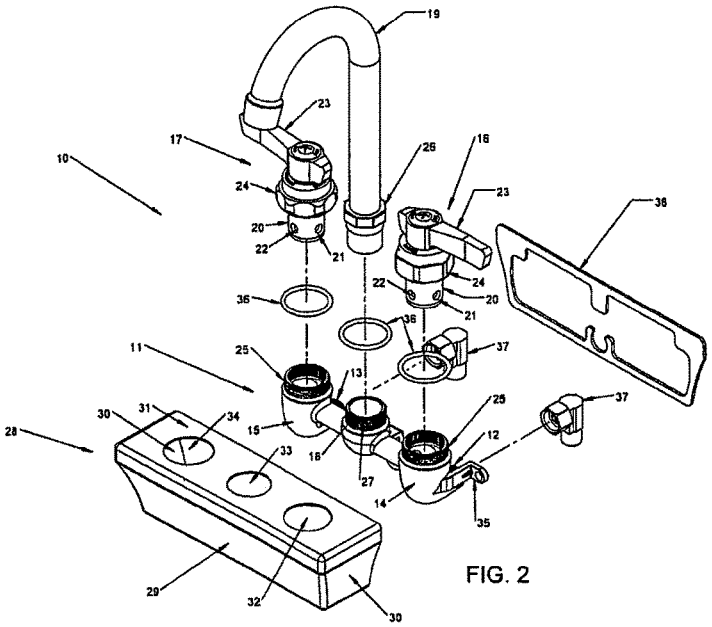
FIG. 2 illustrates an explodes view of the faucet assembly of FIG. 1.

Referring to FIG. 2, the faucet assembly 10 comprises a body 11, for example, of one piece construction made of metal and having a first externally threaded inlet port 12 for connection to a source of cold water and a second externally threaded inlet port 13 for connection to a source of hot water. In addition, the body 11 has a pair of cylindrical chambers 14, 15 for receiving a pair of valve assemblies 16, 17 that control the flow of water from the inlet ports 12, 13 as well as an outlet port 18 that communicates with a spigot 19 for the outflow of water.

One valve assembly 16 is mounted on the body 11 in communication with the first inlet port 12 for selectively controlling a supply of water from the first inlet port 12 to the spigot 19 and the other valve assembly 17 is mounted on the body 11 in communication with the second inlet port 13 for selectively controlling a supply of water from the second inlet port 13 to the spigot 19.

As illustrated, each valve assembly 16, 17 has a hollow cylindrical stem 20 with two openings 21, 22. Upon turning of the stem 20, one opening 21 is brought into alignment with the inlet port 12 of the body 11 while the other opening 22 is brought into alignment with the interior of the body leading to the spigot 15.

In addition, a handle 23 is connected to each valve assembly 16, 17 for manually regulating a flow of cold water or hot water from the respective valve assembly 16, 17 by turning of the handle 23 which, in turn, rotates the stem 20.

A nut 24 threadably secures each respective valve assembly 16, 17 to the body 11. As illustrated, each nut 24 is disposed about the stem 20 of a respective valve assembly 16, 17 that threads onto an external thread 25 of a respective cylindrical chamber 14, 15. As is conventional, the stem 20 is provided with an annular shoulder (not shown) against which an inner annular shoulder (not shown) of the nut 24 abuts to secure the stem 20 in the respective chamber 14, 15.

The spigot 19 is sized to slidably fit into the outlet port 18 and carries an internally threaded nut 26 that threads onto an external thread 27 on the outlet port 18 to secure the spigot 19 to the outlet port 18 in a conventional manner. For example, the spigot 19 may be provided with an O-ring bushing Model KN11-X115, marketed by Component Hardware Group, Inc. of Lakewood, N.J. to facilitate direct threading of the nut 26 with Loctite® adhesive applied.

In accordance with the invention, the faucet assembly 10 includes a housing 28 that is removably mounted over the body 11 to enclose the body 11 therein with the valve assemblies 16, 17 and spigot 19 projecting therethrough.

As illustrated, the housing 28 is of one-piece shell-like construction having a front wall 29, a pair of side walls 30, a top panel 31 and a bottom panel (not shown). The back of the housing 28 is open so that the housing 28 may be slid over and onto the body 11.

The housing 28 may also be made without a bottom panel to enclose the body 11 on four sides.

The top panel 31 of the housing 28 has three circular openings 32, 33, 34 that are sized to fit over the cylindrical chambers 14, 15 and outlet port 18.

The body 11 is provided with a pair of mounting brackets 35 (only one of which is shown), each at an opposite end of the body 11 as well as three O-rings 36, each of which is to seat about a cylindrical chamber 14, 15 and outlet port 18.

Figure 3:
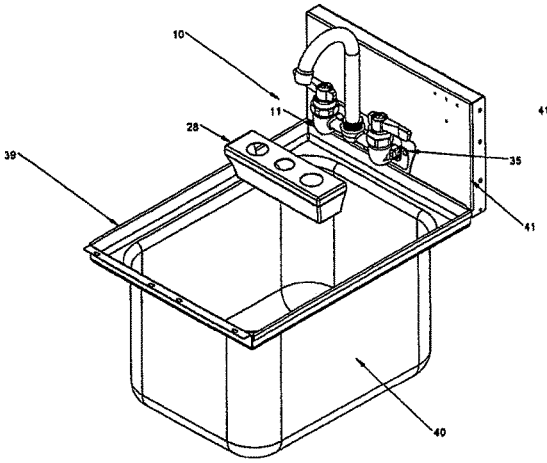
FIG. 3 illustrates a perspective view of the faucet assembly of FIG. 1 mounted on a sink in accordance with the invention.

In addition, a pair of suitable connectors 37 provides for communication of the inlet ports 12, 13 with sources of cold water and hot water, respectively, and a gasket 38 is provided to seal about the edges of the housing 28. Each connector 37 may be constructed as illustrated or may be of a conventional elbow type of connector (not shown). Typically, each connector 37 has a nut 37' for threading of the connector 37 onto the external thread of an inlet port 12, 13 as indicated in FIG. 6, Referring to FIG. 3, the faucet assembly 10 is front mounted on a sink 39 of conventional structure comprising a tub 40 and a splash board 41 connected to and extending upwardly from a rear of the tub 40.

Figure 4:
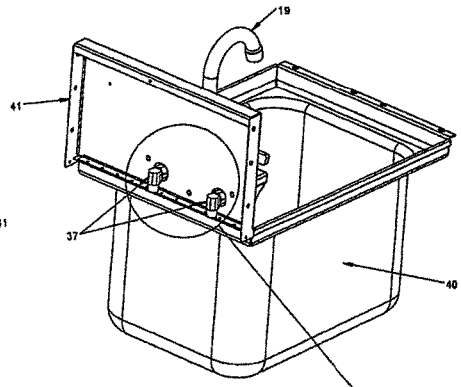
FIG. 4 illustrates a perspective rear view of the sink of FIG. 3.
Figure 5:
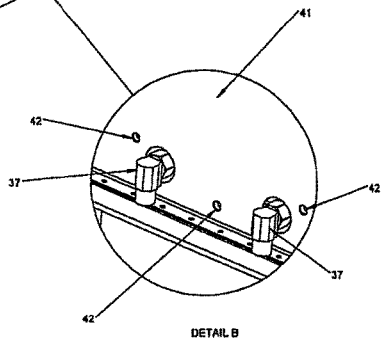
FIG. 5 illustrates an enlarged detail view of a connection for connecting the faucet assembly to a source of water.
Figure 6:
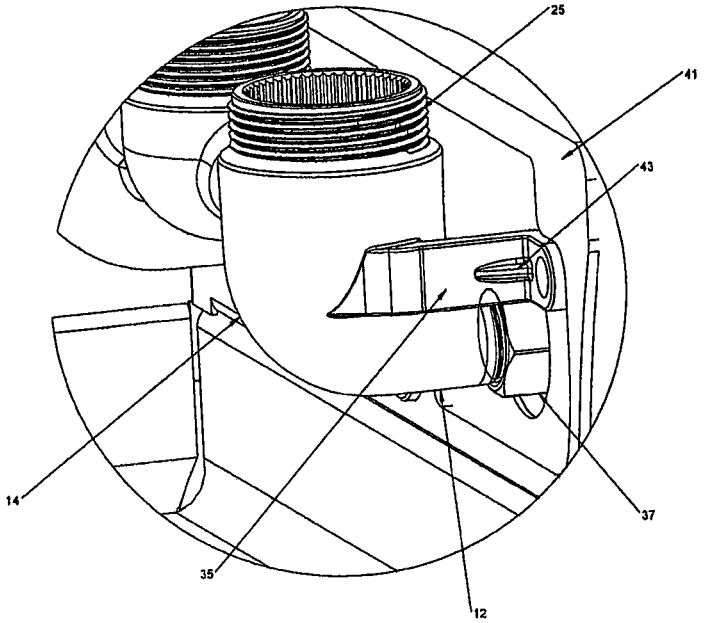
FIG. 6 illustrates an enlarged detail view of the faucet assembly mounted on the splash board of the sink of FIG. 3.

In accordance with the invention, in order to front mount the faucet assembly 10 on the sink 39, the connectors 37 that are secured to the inlet ports 12, 13 (not shown) of the body 11 of the faucet assembly 10 are passed through enlarged openings 42 in the splash board 41 as indicated in FIGS. 4 and 5, and the body 11 is secured to the splash board 41 via the brackets 35, for example using self-threading screws 43 as indicated in FIG. 6. In addition, the O-rings 36 are positioned about the cylindrical chambers 14, 15 and outlet port 18, and the gasket 38 is passed over the body 11 and positioned in place against the splash board 41.

Next, the housing 28 is moved over the body 11 and dropped into place with the externally threaded ends of the cylindrical chambers 14, 15 and outlet port 18 protruding through the three circular openings 32, 33, 34. The housing 28 is butted against the gasket 38 so as to seal the resulting chamber that fully encloses the body 11 but for the circular openings 32, 33, 34. In addition, the top panel 31 of the housing 28 seals against the O-rings 36.

Figure 1:
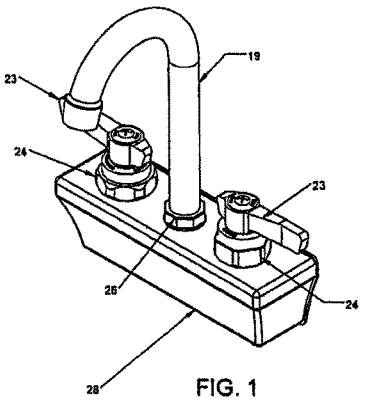
FIG. 1 illustrates a perspective view of a faucet assembly of the invention.

Thereafter, the stem 20 of each of the valve assemblies 16, 17 is inserted into a respective cylindrical chamber 14, 15 of the body 11 and the respective nut 24 threaded onto the protruding external thread 25 to abut the top panel 31 of the housing 28 as indicated in FIG. 1.

The spigot 19 is also mounted in the outlet port 18 and the nut 26 on the spigot 19 threaded onto the protruding threaded end of the outlet port 18.

If not already in place, the handles 23 are secured to the valve assemblies 16, 17.

In order to remove the faucet body 11 for repair, the nuts 24 on the valve assemblies 16, 17 and the nut 26 on the spigot 19 are unthreaded from the body 11 and the valve assemblies 16, 17 and spigot 19 are removed. The housing 28 may then be removed to expose the body 11.

Once exposed, the screws 43 that mount the body 11 to the splash board 41 can be unthreaded so that the body 11 with the connectors 37 thereon may be removed from the splash board 41.

Alternatively, the connectors 37 may be unthreaded from the body 11 to remain in place. As indicated in FIG. 6, the nut 37' of each connector 37 projects, in part, through an opening 42 in the splash board 41 so as to be readily accessed manually.

Should braided hoses be used to deliver water to the connectors 37, a disconnect may occur under the sink 39 and the hoses may be pulled through the openings 42 in the splash board 41.

The invention thus provides a faucet assembly for a sink that is mounted from the front of the sink to allow easy removal and repair when necessary.

What is claimed is:

1. A sink comprising a tub;

a splash board connected to and extending upwardly from a rear of said tub, said splash board having a pair of openings therein;

a faucet assembly mounted on said splash board for delivering water into said tub, said faucet assembly including a body having a first inlet port for connection to a source of cold water, a second inlet port for connection to a source of hot water, a spigot in communication with said first inlet port and said second inlet port for delivering water therefrom, and a pair of connectors received in said openings of said splash board, each said connector having a nut threaded onto a respective inlet port for securing said respective inlet port to a respective source of hot water and cold water;

a housing removably mounted over said body to enclose said body therein with said spigot projecting therethrough; and a gasket disposed in sealing relation between said housing and said splash board.

2. A sink as set forth in claim 1 further comprising a valve assembly mounted on said body in communication with said first inlet port for selectively controlling a supply of water from said first inlet port to said spigot.

3. A sink as set forth in claim 2 further comprising a first nut threadably securing said valve assembly to said body and being disposed exteriorly of and in abutment with said housing, a second nut threadably securing said spigot to said body and being disposed exteriorly of and in abutment with said housing.

4. A sink as set forth in claim 1 further comprising a pair of mounting brackets securing said body to a vertically disposed surface of said splash board.

5. A sink comprising a tub;

a splash board connected to and extending upwardly from a rear of said tub;

a faucet assembly mounted on said splash board for delivering water into said tub, said faucet assembly including a body having a first inlet port for connection to a source of cold water, a second inlet port for connection to a source of hot water and an outlet port for an outflow of water from each said inlet port, a spigot in communication with said outlet port for delivering water therefrom, a first valve assembly mounted on said body in communication with said first inlet port for selectively controlling a supply of water from said first inlet port to said spigot, a second valve assembly mounted on said body in communication with said second inlet port for selectively controlling a supply of water from said second inlet port to said spigot, and a pair of mounting brackets securing said body to a vertically disposed surface of said splash board;

a housing removably mounted over said body to enclose said body therein with said first valve assembly projecting therethrough, said second valve assembly projecting therethrough and said spigot projecting therethrough; and a gasket disposed in sealing relation between said housing and said splash board.

6. A sink as set forth in claim 5 further comprising a first connector in communication with said first inlet port and extending through said splash board and a second connector in communication with said second inlet port and extending through said splash board.

* * * * *